US006595320B2

(12) United States Patent
Hwang et al.

(10) Patent No.: US 6,595,320 B2
(45) Date of Patent: Jul. 22, 2003

(54) APPARATUS FOR CONTROLLING EXHAUST GAS IN INTERNAL COMBUSTION ENGINE

(75) Inventors: Yo Ha Hwang, Seoul-si (KR); Jong Min Lee, Kyungki-do (KR)

(73) Assignee: Korea Institute of Science & Technology, Seoul (KR)

( * ) Notice: Subject to any disclaimer, the term of this patent is extended or adjusted under 35 U.S.C. 154(b) by 70 days.

(21) Appl. No.: 09/878,399

(22) Filed: Jun. 12, 2001

(65) Prior Publication Data

US 2002/0153198 A1 Oct. 24, 2002

(30) Foreign Application Priority Data

Apr. 18, 2001 (KR) ..... 2001-20882

(51) Int. Cl.[7] ..... F01N 1/00
(52) U.S. Cl. ..... 181/253; 181/241
(58) Field of Search ..... 181/253, 216, 181/241, 271, 277, 278, 219, 258, 265

(56) References Cited

U.S. PATENT DOCUMENTS

| | | | | | |
|---|---|---|---|---|---|
| 3,038,553 | A | * | 6/1962 | Peters | 181/271 |
| 4,384,507 | A | * | 5/1983 | Finn | 181/241 |
| 5,271,224 | A | * | 12/1993 | Cruickshank | 181/241 |
| 5,426,269 | A | * | 6/1995 | Wagner et al. | 181/264 |
| 5,475,189 | A | * | 12/1995 | Field et al. | 181/241 |
| 6,234,758 | B1 | * | 5/2001 | Pawelski | 417/26 |
| 2002/0036114 | A1 | * | 3/2002 | Tobias | 181/241 |

FOREIGN PATENT DOCUMENTS

| | | | | | |
|---|---|---|---|---|---|
| EP | 1067511 | A2 | * | 1/2001 | G10K/11/175 |
| GB | 2156053 | A | * | 10/1985 | F41B/11/00 |
| JP | 57135212 | A | * | 8/1982 | F01N/1/02 |
| JP | 2001003726 | A | * | 1/2001 | F01N/1/08 |
| JP | 2001050024 | A | * | 2/2001 | F01N/1/06 |

* cited by examiner

*Primary Examiner*—Robert E. Nappi
*Assistant Examiner*—Edgardo San Martin
(74) *Attorney, Agent, or Firm*—Birch, Stewart, Kolasch & Birch, LLP

(57) ABSTRACT

An apparatus for controlling exhaust noise in an internal combustion engine uses the length difference between the exhaust pipe and the bypass pipe. The apparatus includes an exhaust pipe for outwardly releasing exhaust gas from the engine; a bypass pipe variable in length which diverges from said exhaust pipe with a distance and has U-shaped and reverse U-shaped sections formed alternately; an actuator having an actuating rod connected to the bypass pipe to vary the length of the bypass pipe; and a control unit for controlling the actuator. The bypass pipe has the U-shaped and reverse U-shaped sections arranged alternately so that the variable length of the bypass pipe can be extended while minimizing the space for installing the bypass pipe, and thereby noise in the low frequency band can be suitably reduced. Also, the exhaust pipe is additionally provided with a device for adjusting the length to increase the length difference with the bypass pipe so that noise in a wider band can be controlled.

20 Claims, 4 Drawing Sheets

APPARATUS FOR CONTROLLING EXHAUST GAS IN INTERNAL COMBUSTION ENGINE

BACKGROUND OF THE INVENTION

1. Field of the Invention

The present invention relates to an apparatus for controlling exhaust noise in an internal combustion engine, in particular, in which a bypass pipe diverging from an exhaust pipe is composed of a U-shaped section and a reverse U-shaped section to minimize the installation space of the bypass pipe, and the length difference between the exhaust pipe and the bypass pipe is enlarged so that a noise in a low frequency band can be suitably controlled.

2. Description of the Related Art

In general, mufflers are used for restricting exhaust noise of the internal combustion engine such as engines of vehicles. However, the mufflers have a complicated structure so that pneumatic resistance of exhaust gas is increased while passing the muffler thereby increasing back pressure of the engines and thus reducing efficiency of the internal combustion engines.

Also, since exhaust noise of the vehicles has main components changing according to variation of engine rotation speed, it is difficult to manufacture a muffler which can be effectively operated across the overall rotation speed of an engine.

Meanwhile, in order to overcome disadvantages of the method for restricting exhaust noise by using the muffler, researches are being actively carried out about active control of exhaust noise as a new noise controlling method. As an example of typical methods about the active controlling method which are being currently researched, there is an apparatus for controlling exhaust noise by using a speaker in which noise is measured to judge data by using a noise measuring microphone installed in the exhaust pipe for allowing exhaust gas to pass through, in which the data are outputted through the speaker installed in the exhaust pipe which generates destructive sound having the same magnitude and the opposite phase as exhaust noise measured in the microphone to have a destructive interference with exhaust noise, which is a noise source, thereby reducing exhaust noise outwardly released from the vehicle.

However, there are problems that, in the method of generating destructive sound through the speaker installed in the exhaust pipe, a large magnitude of noise is generated from exhaust gas and the main components thereof are in a low frequency band so that the speaker is required to have very high output power to compensate noise and a large magnitude of diameter to generate low frequency sound as the features of the general speaker, whereas there are difficulties for manufacturing and maintaining the speaker in a large size and ensuring space for installation.

Meanwhile, as another example of active control, an apparatus for actively controlling a path difference in a pipe for transferring noise is disclosed in Korean Published Patent Gazette No. 10-1999-2473. The apparatus is provided with a bypass section in which a U-shaped bypass pipe 10 is attached to an exhaust pipe 1 for outwardly releasing exhaust gas of an engine 40 so that an exhaust gas outlet is bypassed into two branches and then combined into one again.

The bypass pipe 10 has fixed members 11 and 12 diverging from the exhaust pipe 1 and a movable member 14 slidingly coupled with the fixed members 11 and 12, in which the length of the bypass pipe 10 is actively varied by an actuator 20 having an actuator rod 20 for sliding the movable member 14 from the fixed members 11 and 12, and a control unit 30 for judging the operation of the actuator 20 if any to output a control signal based upon noise measured from the microphone 32 installed at one side of the exhaust pipe 1 and an rpm signal of the engine.

In such an apparatus for actively controlling noise by using the path difference in the noise transferring pipe, the length the bypass pipe 10 is adjusted so that noise has the phase difference of 180° in passing the bypass pipe 10 and the exhaust pipe 1 thereby to mutually compensate exhaust noise passing the two pipes.

However, in the active noise controlling apparatus by using the path difference of the noise transferring pipe of the related art, the difference between the length a+b+c of the bypass pipe 10 diverging from the exhaust pipe 1 and the length of the exhaust pipe area where exhaust gas passes without flowing into the bypass pipe 10 should be large for compensating low frequency noise in considering that general exhaust noise is in the low frequency band. Accordingly, it is difficult to ensure a space for installing the bypass pipe 10 extended in the lower part of the vehicle and support the actuator 20 and the actuating rod 22 when sliding the movable member 14 in the fixed members 11 and 12 for varying the length of the bypass pipe 10 so that noise in the low frequency band may not be suitably controlled.

Also, hot exhaust gas passes through the bypass pipe 10, which causes a localized thermal deformation to the fixed members 11 and 12 or the movable member 14 thereby deteriorating the sliding operation and endurance of the movable member 14.

Further, when exhaust gas is bypassed into the bypass pipe 10, foreign materials can be introduced into the bypass pipe 10 together with hot exhaust gas so that the sliding operation of the movable member 14 can be obstructed.

SUMMARY OF THE INVENTION

The present invention is proposed to solve the foregoing problems of the related art, and it is therefore an object of the invention to provide an apparatus for controlling exhaust noise of an internal combustion engine in which a bypass pipe connected to an exhaust pipe is alternately provided with U-shaped and reverse U-shaped sections so that a space for installing the bypass pipe can be minimized and the variable length of the bypass pipe can be extended thereby reducing noise in a wide band.

It is another object of the invention to block introduction of foreign materials into the bypass pipe thereby preventing malfunction of the bypass pipe by the foreign materials.

It is further object of the invention to allow the bypass pipe to be varied in the length parallel to the exhaust pipe to reduce noise in the wide band while ensuring suitable installation of the bypass pipe.

According to an embodiment of the invention to obtain the foregoing objects, it is provided an apparatus for controlling exhaust gas in an internal combustion engine, comprising: an exhaust pipe for outwardly releasing exhaust gas from the engine; a bypass pipe variable in length which diverges from said exhaust pipe with a distance and has U-shaped and reverse U-shaped sections formed alternately; an actuator having an actuating rod connected to said bypass pipe to vary the length of said bypass pipe; and a control unit for controlling said actuator.

According to another embodiment of the invention to obtain the foregoing objects, it is provided an apparatus for controlling exhaust gas in an internal combustion engine, comprising: an exhaust pipe for outwardly releasing exhaust gas from the engine; a movable bypass pipe diverging from said exhaust pipe with a distance and arranged parallel to said exhaust pipe and variable along the length of said exhaust pipe; an actuator having an actuating rod connected to said bypass pipe to vary the length of said bypass pipe; and a control unit for controlling said actuator.

According to further another embodiment of the invention to obtain the foregoing objects, it is provided an apparatus for controlling exhaust gas in an internal combustion engine, comprising: an exhaust pipe for outwardly releasing exhaust gas from the engine; a main bypass pipe diverging from said exhaust pipe with a distance and having a variable length; an auxiliary bypass pipe diverging from said main bypass pipe with a distance and having a variable length; an actuator having an actuating rod connected to said bypass pipe to vary the length of said bypass pipe; and a control unit for controlling said actuator.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Hereinafter embodiments of the invention will be described in detail in reference to the appended drawings.

Figure 1:
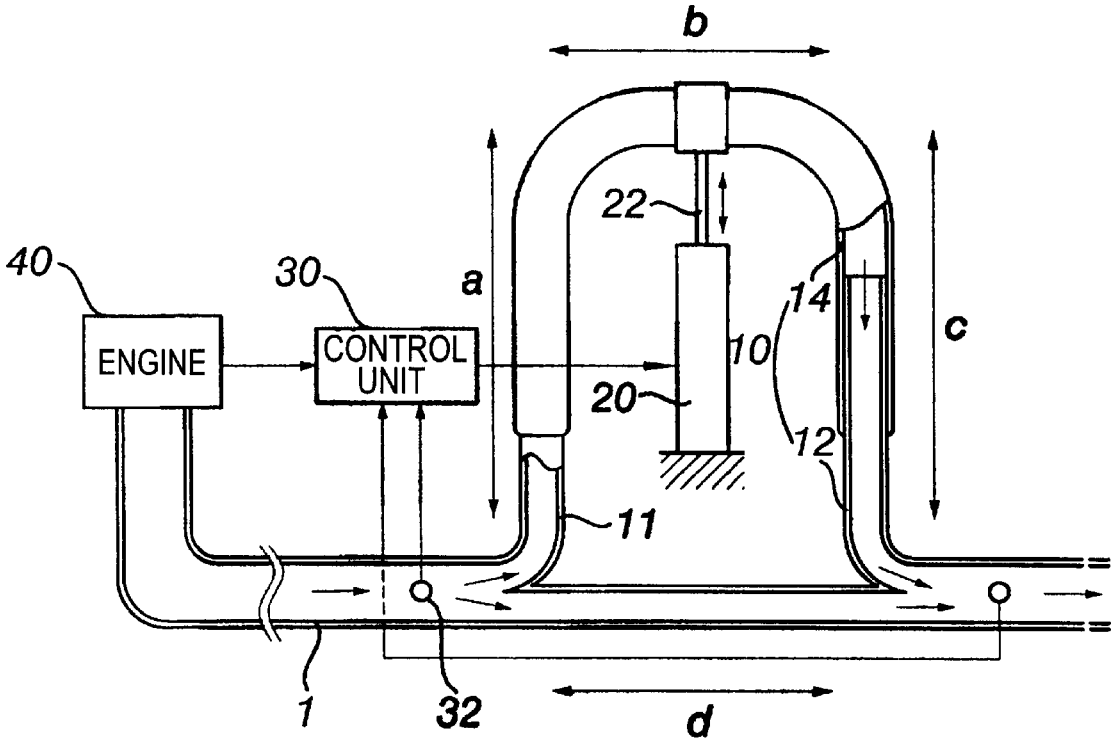
Fig.1 (Prior Art)
FIG. 1 is a partial sectional view for showing main parts of an apparatus for controlling exhaust noise of an internal combustion engine of the related art.
Figure 2:
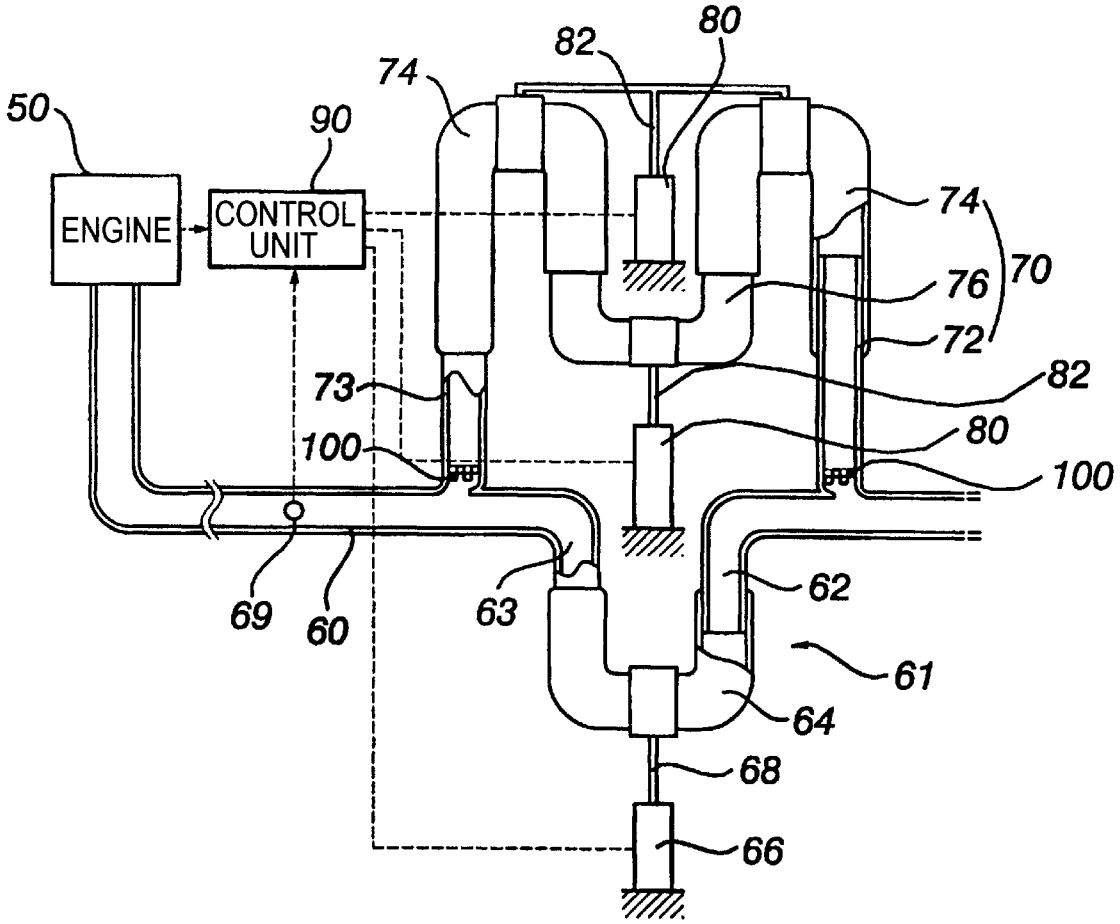
FIG. 2 is a partial sectional view for showing an example bypass pipe of an apparatus for controlling exhaust noise according to the first embodiment of the invention, which is arranged in a zigzag configuration.
Figure 3:
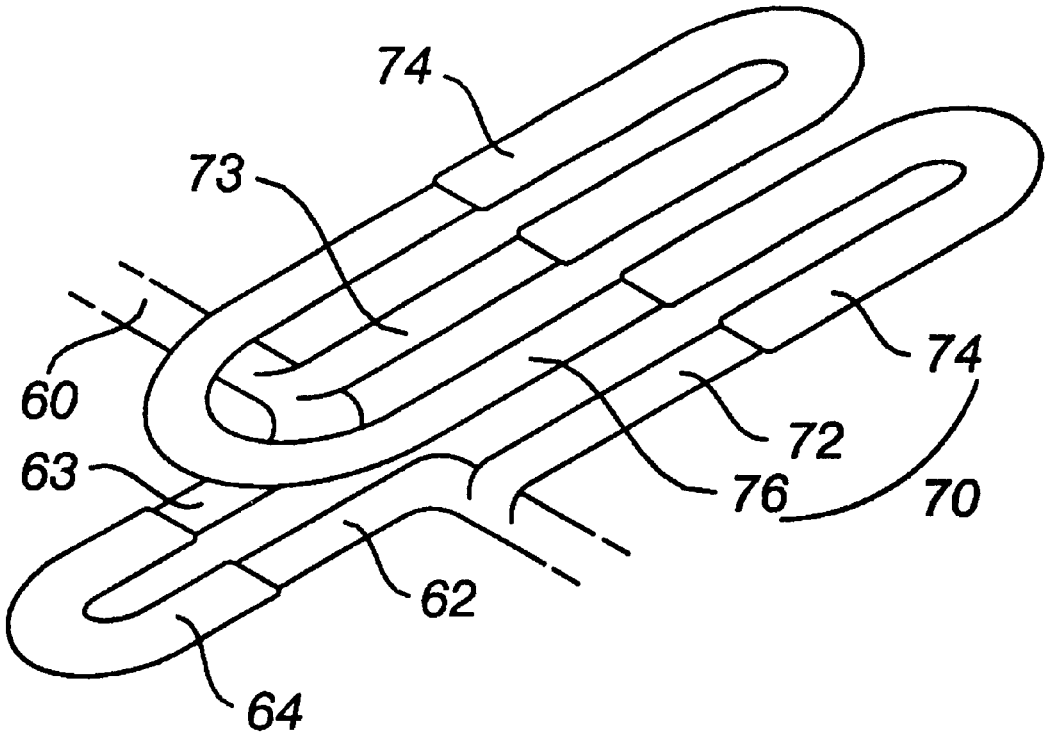
FIG. 3 is a perspective view for showing another example bypass pipe of the apparatus for controlling exhaust noise according to the first embodiment of the invention, which is arranged in a cubical configuration.

FIG. 2 is a partial sectional view for showing an example of bypass pipe of an apparatus for controlling exhaust noise according to the first embodiment of the invention, which is arranged in a zigzag configuration, and FIG. 3 is a perspective view for showing another example of bypass pipe of the apparatus for controlling exhaust noise according to the first embodiment of the invention, which is arranged in a cubical configuration.

Referring to FIG. 2 and FIG. 3, the apparatus for controlling exhaust noise of the internal combustion engine of the invention comprises an exhaust pipe 60 for outwardly releasing exhaust gas from an engine 50, a variable-in-length bypass pipe 70 diverging from the exhaust pipe 60 with a distance and having alternately formed U-shaped and reverse U-shaped sections, actuators 80 having actuating rods 82 connected to the bypass pipe 70 to vary the length of the bypass pipe 70, and a control unit 90 for controlling the actuators 80.

The bypass pipe 70 can be arranged in the zigzag configuration on one plane as shown in FIG. 2, or alternatively can be arranged in the cubical configuration placed on at least two planes in which two bypass pipes 70 arranged on different planes are flexed and connected in U-shape, as shown in FIG. 3.

Also, the bypass pipe 70 has barrier plates 100 with a number of perforations placed downstream of the diverging point from the exhaust pipe 60 and upstream of the converging point to the exhaust pipe 60 for blocking inflow of hot exhaust gas or foreign materials from the exhaust pipe 60.

Meanwhile, the bypass pipe 70 has fixed members 72 and 73 diverging from the exhaust pipe with a distance, reverse U-shaped first movable members 74 insertably coupled with the fixed members 72 and 73, and a U shaped second movable member 76 insertably coupled with the first movable members 74, in which the length of the first and second movable members 74 and 76 are varied according to variation in length of the actuating rods 82 of the actuators 80 operated according to a control signal of the control unit 90.

Figure 4A:
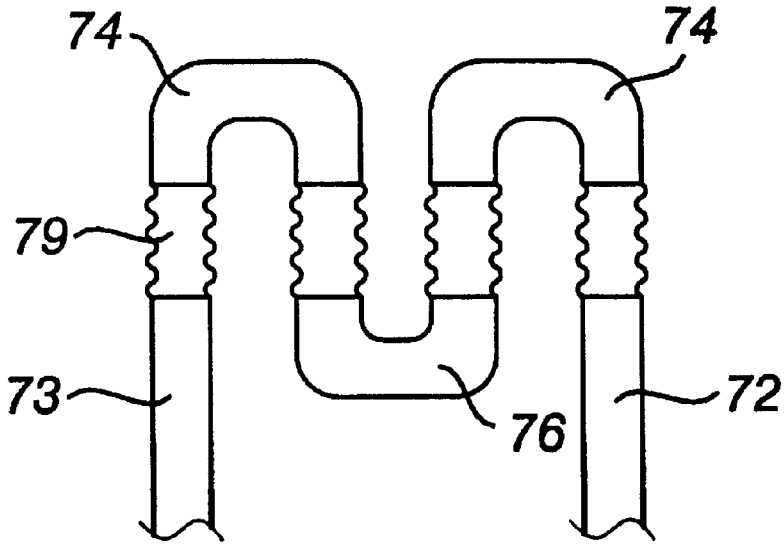
FIG. 4A is a front elevation view for showing further another example of bypass pipe of the apparatus for controlling exhaust noise according to the first embodiment of the invention, which has a bellows type connection.
Figure 4B:
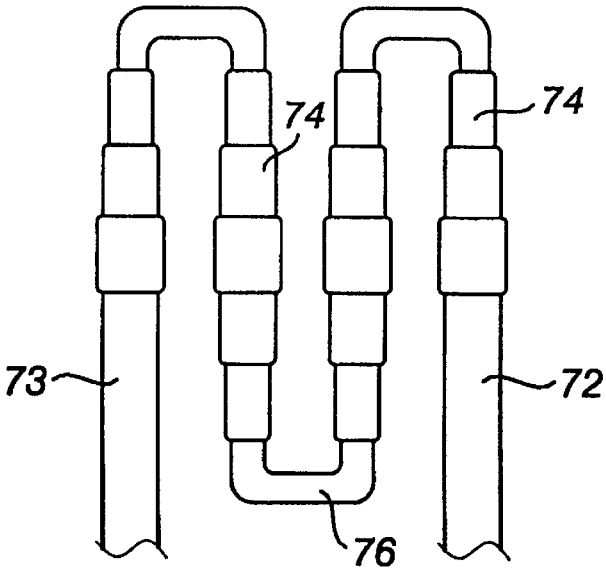
FIG. 4B is a front elevation view for showing other example of bypass pipe of the apparatus for controlling exhaust noise according to the first embodiment of the invention, which is connected telescopically.

FIG. 4A is a front elevation view for showing further another example of bypass pipe of the apparatus for controlling exhaust noise according to the first embodiment of the invention, which has bellows type connection, and FIG. 4B is a front elevation view for showing other example of bypass pipe of the apparatus for controlling exhaust noise according to the first embodiment of the invention, which is connected telescopically.

Here, the bypass pipe 70 is not restricted to the insertable arrangement, whereas the bypass pipe 70 can have a bellows type coupling in which bellows 79 are connected between each of fixed members 72 and 73 and the first movable member 74 and between the first movable member 74 and the second movable member 76, the first and second movable members 74 are made of telescopic pipes which can be easily varied in length, or the second movable member 76 can be fixedly installed at one side between the diverging point and the converging point of the fixed members 72 and 73 from/to the exhaust pipe 60 so that the length of the bypass pipe 70 can be varied only with the movement of the first movable member 74.

The exhaust pipe 60 further includes the first and second cylindrical members 62 and 63 flexed at the inner side of the diverging/converging points of the bypass pipe 70, a U-shaped movable member 64 insertably coupled to the first and second cylindrical members 62 and 63, and an adjusting device 61 for adjusting the length of the exhaust pipe 60. The adjusting device 61 is composed of an extensible actuator 66 having an actuation rod 68 connected to the movable member 64 for slidingly displacing the movable member 64 according to the signal from the control unit 90.

In FIG. 2, the first and second cylindrical members 62 and 63 and the movable member 64 are insertably coupled and capable of sliding. However, the first and second cylindrical members 62 and 63 and the movable member 64 can have a bellows type coupling as in the bypass pipe 70, or the movable member 64 can be made of a telescopic pipe.

Here, in addition that the first and second cylindrical members 62 and 63 and the movable member 64 are insertably coupled capable of sliding, the first and second cylindrical members 62 and 63 and the movable member 64 can have a bellows type coupling as in the bypass pipe 70, or the movable member 64 can be made of a telescopic pipe.

Meanwhile, in addition that the extensible actuator 66 is additionally installed, the actuators 80 for varying the length of the bypass pipe 70 can be additionally provided with an actuating rod (not shown) for moving the movable member 64 of the exhaust pipe 60.

The actuators 80 for varying the length of the bypass pipe 70 and the extensible actuator for varying the length of the exhaust pipe 60 are fixedly installed in a vehicle body side (not shown).

The control unit 90 receives and analyzes a signal from an accelerometer (not shown) installed in the engine 50 or a signal from a microphone 69 installed in the exhaust pipe 60 to calculate main components of engine noise, and then activates the actuators 66 and 80 such as a pneumatic cylinder to adjust the length of the bypass pipe 70 or the exhaust pipe 60.

The operation of the apparatus for controlling exhaust noise according to the first embodiment of the invention configured like this will be described as follows.

First, when the engine 50 is operated, the control unit 90 receives the signal from a controller or the accelerometer (not shown) of the engine 50 or the microphone 69 to judge a wavelength of destructive noise which is half-wave different from main noise and determine the length difference of the bypass pipe 70 and the exhaust pipe 60, by which exhaust noise passing the bypass pipe 70 becomes destructive noise of exhaust noise passing the exhaust pipe 60 without passing through the bypass pipe 70, and then activates the actuators 66 and 80.

Here, the actuating rods 82 of the actuators 80 push or pull the movable members 74 and 76, which are arranged slidingly or telescopically or have a bellows type connection to the fixing members 72 and 73, to change the overall length of the bypass pipe 70. The actuating rod 68 of the extensible actuator 66 pushes or pulls the movable member 64, which is arranged slidingly or telescopically or has a bellows type connection to the first and second cylindrical members 62 and 63, to change the overall length of the exhaust pipe 60.

Describing this in more detail, the control unit 90 minimizes the length defined by the first and second cylindrical members 62 and 63 and the movable member 64 while maximizing the length of the bypass pipe 70 when the main noise components generated from the engine 50 are in a low frequency band. When the main noise components are in a high frequency band, the control unit 90 maximizes the length defined by the first and second cylindrical members 62 and 63 and the movable member 64 while minimizing the length of the bypass pipe 70. Then, exhaust noise passing the exhaust pipe 60 and exhaust noise passing the bypass pipe 70 can be adjusted to have a difference of half-wave.

Meanwhile, hot exhaust gas or foreign materials introduced from the exhaust pipe 60 to the bypass pipe 70 is blocked by the barrier plate 100 with a number of perforations, and the bypass pipe 70 is thereby minimized with thermal deformation due to hot exhaust gas and malfunction related thereto.

Meanwhile, the apparatus for controlling exhaust gas of the internal combustion engine of the invention is not restricted to the first embodiment, but can have a plurality of second movable members 76 with alternately arranged U-shaped sections and reverse U-shaped sections to control noise in a wider range. Also, in addition to the configuration in which the actuators 66 and 80 respectively shift the first and second movable members 74 and 76 of the bypass pipe 70 and movable member 64 of the exhaust pipe 60, one actuator can shift the first and second movable members 74 and 76 of the bypass pipe 70 and movable member 64 of the exhaust pipe 60 also.

Figure 5:
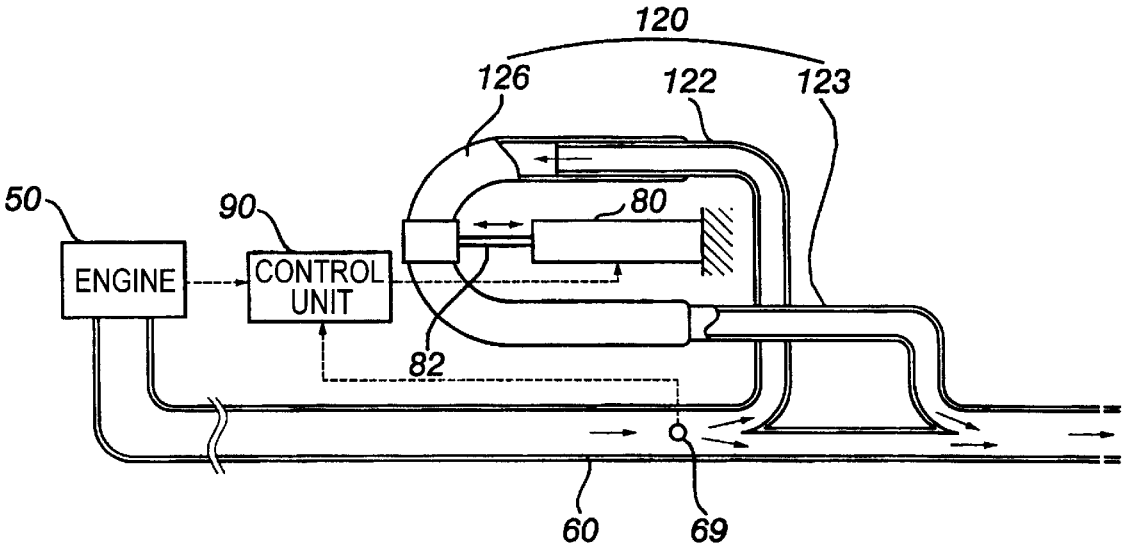
FIG. 5 is a partial sectional view for showing a bypass pipe of an apparatus for controlling exhaust noise according to the second embodiment of the invention, which is arranged parallel to an exhaust pipe.

FIG. 5 is a partial sectional view for showing a bypass pipe of an apparatus for controlling exhaust noise according to the second embodiment of the invention, which is arranged parallel to an exhaust pipe.

As shown in FIG. 5, the apparatus for controlling exhaust noise of this embodiment comprises an exhaust pipe 60 for outwardly releasing exhaust gas of an engine 50, a movable bypass pipe 120 diverging from the exhaust pipe 60 with a distance and arranged parallel to the exhaust pipe 60 and variable along the length of the exhaust pipe 60, an actuator 80 having an actuating rod 82 connected to the bypass pipe 120 for varying the length of the bypass pipe 120 and a control unit 90 for controlling the actuator 80.

Except that the bypass pipe 120 is arranged parallel to the exhaust pipe 60, the structure and operation of the actuator 80 and the control unit 90 are the same as in the first embodiment. The bypass pipe 120, as in the first embodiment, may include the first and second fixed members 122 and 123 diverging from the exhaust pipe 60 with a distance and a movable member 126 which has an insertion or bellows type connection with each of the fixed members 122 and 123 and is connected with the actuating rod 82, or may be arranged telescopically.

Meanwhile, the first and second fixed members 122 and 123, after diverging and extended with a certain length from the exhaust pipe 60, are flexed forward or backward parallel to the exhaust pipe 60, in which the ends thereof are connected with the movable member 126 which is arranged parallel to the exhaust pipe 60.

It will be described as follows about the operation of the apparatus for controlling exhaust noise of an internal combustion engine according to the second embodiment of the invention configured like this.

First, when the engine 50 is activated, as in the first embodiment, the control unit 90 receives a signal from a controller, an accelerometer or a microphone 69 of the engine to judge a wavelength of destructive noise which is half-wave different from main noise components of exhaust gas released from the engine 50 and determine the length of the bypass pipe 120, and then activate the actuator 80. The actuating rod 82 of the actuator 80 pushes or pulls the movable member 126 parallel to the exhaust pipe so that the wavelength of an exhaust gas flow bypassing through the first and second movable members 122 and 123 and the movable member 126 may be adjusted to have a phase difference of 180° with the wavelength of another exhaust gas flow which does not bypass the first and second movable members 122 and 123 and the movable member 126, thereby reducing main noise of exhaust gas.

Here, the bypass pipe 120, since being arranged parallel to the exhaust pipe 60, can more suitably control noise in a low frequency band while allowing more suitable installation to the vehicle body side.

According to the apparatus for controlling exhaust noise in an internal combustion engine configured as above according to the invention, the exhaust pipe for releasing exhaust gas is provided with the bypass pipe having the U-shaped and reverse U-shaped sections arranged alternately so that the variable length of the bypass pipe can be extended while minimizing the space for installing the bypass pipe, and thereby noise in the low frequency band can be suitably reduced. Also, the exhaust pipe is additionally provided with the means for adjusting the length to increase the length difference with the bypass pipe so that noise in a wider band can be controlled.

Also, the bypass pipe is installed with the barrier plates downstream of the diverging point from the exhaust pipe and upstream of the converging point to the exhaust pipe to prevent that the operation of varying the length of the bypass pipe may be degraded by hot exhaust gas or the foreign materials.

Further, the bypass pipe is arranged parallel to the exhaust pipe for outwardly releasing exhaust gas so that the variable length of the bypass pipe can be extended while allowing the bypass pipe to be suitably installed to the vehicle side, thereby reducing noise in a wide band.

Moreover, the main bypass pipe is installed to the exhaust pipe for outwardly releasing exhaust gas and the auxiliary bypass pipe is installed to the bypass pipe so that the length of the main and auxiliary bypass pipes is adjusted by the actuators. Thus, the variable length of the main and auxiliary bypass pipes can be extended and thereby noise in the low frequency band can be suitably reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for controlling exhaust gas in an internal combustion engine, comprising:

an exhaust pipe for outwardly releasing exhaust gas from the engine;

a bypass pipe, said bypass pipe being variable in length and diverging from and converging with said exhaust pipe, said bypass pipe having at least one U-shaped section and at least one reverse U-shaped section formed alternately between the diverging and converging points with said exhaust pipe;

an actuator having an actuating rod connected to said bypass pipe to vary the length of said bypass pipe; and a control unit for controlling said actuator.

2. The apparatus for controlling exhaust gas in an internal combustion engine according to claim 1, wherein said bypass pipe is arranged in a zigzag configuration on a plane.

3. The apparatus for controlling exhaust gas in an internal combustion engine according to claim 1, wherein said bypass pipe is arranged on at least two planes, wherein a portion of said bypass pipe on one plane and another portion of said bypass pipe on another plane are connected in a flexed, U-shaped manner.

4. The apparatus for controlling exhaust gas in an internal combustion engine according to claim 1, wherein said bypass pipe is provided with a barrier plate having a number of perforations and placed at the bypass pipe side of the diverging point of said exhaust pipe.

5. The apparatus for controlling exhaust gas in an internal combustion engine according to claim 1, wherein said bypass pipe includes fixed members diverging from arid converging with said exhaust pipe, reverse U-shaped first movable members insertably arranged to said fixed members, and a U-shaped second movable member insertably arranged to said first movable member, wherein said first and second movable members are varied in length according to a variation in length of said actuating rod of said actuator which is actuated according to a control signal from said control unit.

6. The apparatus for controlling exhaust gas in an internal combustion engine according to claim 1, wherein said bypass pipe includes fixed members diverging from and converging with said exhaust pipe, reverse U-shaped first movable members connected with said fixed member with a bellows, respectively, and a U-shaped second movable member connected with said first movable members with a bellows, wherein said first and second movable members are varied in length according to a variation in length of said actuating rod of said actuator which is actuated according to a control signal from said control unit.

7. The apparatus for controlling exhaust gas in an internal combustion engine according to claim 1, wherein said bypass pipe includes fixed members diverging from and converging with said exhaust pipe, reverse U-shaped telescopic first movable members connected with said fixed members, respectively, and a U-shaped telescopic second movable member connected with said first movable members, wherein said first and second movable members are varied in length according to a variation in length of said actuating rod of said actuator which is actuated according to a control signal from said control unit.

8. The apparatus for controlling exhaust gas in an internal combustion engine according to claim 1, wherein said bypass pipe includes first fixed members diverging from and converging with said exhaust pipe, first and second reverse U-shaped movable members movably arranged to said first fixed members, respectively, a U-shaped second fixed member fixed between said first and second reverse U-shaped movable members, said first and second reverse U-shaped movable members being movable with respect to said second fixed member, wherein said first and second reverse U-shaped movable members are varied in length according to a variation in length of said actuating rod of said actuator which is actuated according to a control signal from said control unit.

9. The apparatus for controlling exhaust gas in an internal combustion engine according to claim 1, wherein said exhaust pipe has a means for adjusting the length of said exhaust pipe including: first and second cylindrical members flexed between the converging and diverging points with the exhaust pipe, a U-shaped movable member insertably arranged to said first and second cylindrical members, and an extensible actuator with an actuating rod connected with said movable member for slidingly shifting said movable member according to a signal from said control unit.

10. The apparatus for controlling exhaust gas in an internal combustion engine according to claim 1, wherein said exhaust pipe has a means for adjusting the length of said exhaust pipe including: first and second cylindrical members flexed between converging and diverging points with the exhaust pipe, U-shaped movable members connected with said first and second cylindrical members with bellows, and an extensible actuator with an actuating rod connected with said movable member for varying the length of said bellows according to a signal from said control unit.

11. The apparatus for controlling exhaust gas in an internal combustion engine according to claim 1, wherein said exhaust pipe has a means for adjusting the length of said exhaust pipe including: first and second cylindrical members flexed between the converging and diverging points with the exhaust pipe, U-shaped movable members telescopically connected with said first and second cylindrical members, and an extensible actuator with an actuating rod connected with said movable member for slidingly shifting said movable member according to a signal from said control unit.

12. An apparatus for controlling exhaust gas in an internal combustion engine, comprising:

an exhaust pipe for outwardly releasing exhaust gas from the engine;

a movable bypass pipe, said movable bypass pipe diverging from and converging with said exhaust pipe and having a length arranged parallel to a length direction of said exhaust pipe, said movable bypass pipe being movable in the length direction of said exhaust pipe to vary the length of said movable bypass pipe;

an actuator having an actuating rod connected to said bypass pipe to vary the length of said bypass pipe; and a control unit for controlling said actuator.

13. An apparatus for controlling exhaust gas in an internal combustion engine, comprising:

an exhaust pipe for outwardly releasing exhaust gas from the engine;

at least one main bypass pipe diverging from and converging with said exhaust pipe and having a variable length;

at least one auxiliary bypass pipe diverging from and converging with said main bypass pipe and having a variable length, said at least one auxiliary bypass pipe being movable with respect to said at least one main bypass pipe;

an actuator having an actuating rod connected to said at least one main bypass pipe to vary the length of said at least one main bypass pipe; and a control unit for controlling said actuator.

14. The apparatus for controlling exhaust gas in an internal combustion engine according to claim 1, wherein said at least one U-shaped section is movable in a direction toward said exhaust pipe to increase the length of said bypass pipe, said at least one reverse U-shaped section is movable in a direction away from said exhaust pipe to increase the length of said bypass pipe.

15. The apparatus for controlling exhaust gas in an internal combustion engine according to claim 12, wherein said movable bypass pipe includes fixed members diverging from and converging with said exhaust pipe, and a movable member movably connected to said fixed members, each of said fixed members having a first portion extending in a direction perpendicular to the length direction of said exhaust pipe and a second portion extending parallel to the length direction of said exhaust pipe, said movable member being slidable along said second portion of said fixed members.

16. The apparatus for controlling exhaust gas in an internal combustion engine according to claim 13, wherein said at least one main bypass pipe is movable in a direction toward said exhaust pipe to increase the length of said at least one main bypass pipe, said at least one auxiliary bypass pipe is movable in a direction away from said exhaust pipe to increase the length of said at least one auxiliary bypass pipe.

17. An apparatus for controlling exhaust gas in an internal combustion engine, comprising:

an exhaust pipe for outwardly releasing exhaust gas from the engine;

a bypass pipe variable in length which diverges from said exhaust pipe with a distance and has U-shaped and reverse U-shaped sections formed alternately;

an actuator having an actuating rod connected to said bypass pipe to vary the length of said bypass pipe; and a control unit for controlling said actuator, wherein said bypass pipe includes fixed members diverging from said exhaust pipe with a distance, reverse U-shaped first movable members insertably arranged to said fixed members, and a U-shaped second movable member insertably arranged to said first movable member, and wherein said first and second movable members are varied in length according to a variation in length of said actuating rod of said actuator which is actuated according to a control signal from said control unit.

18. An apparatus for controlling exhaust gas in an internal combustion engine, comprising:

an exhaust pipe for outwardly releasing exhaust gas from the engine;

a bypass pipe variable in length which diverges from said exhaust pipe with a distance and has U-shaped and reverse U-shaped sections formed alternately;

an actuator having an actuating rod connected to said bypass pipe to vary the length of said bypass pipe; and a control unit for controlling said actuator, wherein said bypass pipe includes fixed members diverging from said exhaust pipe with a distance, reverse U-shaped first movable members connected with said fixed members with bellows, and a U-shaped second movable member connected with said first movable members with bellows, and wherein said first and second movable members are varied in length according to a variation in length of said actuating rod of said actuator which is actuated according to a control signal from said control unit.

19. An apparatus for controlling exhaust gas in an internal combustion engine, comprising:

an exhaust pipe for outwardly releasing exhaust gas from the engine;

a bypass pipe variable in length which diverges from said exhaust pipe with a distance and has U-shaped and reverse U-shaped sections formed alternately;

an actuator having an actuating rod connected to said bypass pipe to vary the length of said bypass pipe; and a control unit for controlling said actuator, wherein said bypass pipe includes fixed members diverging from said exhaust pipe with a distance, reverse U-shaped telescopic first movable members connected with said fixed members, and a U-shaped telescopic second movable member connected with said first movable members, and wherein said first and second movable members are varied in length according to a variation in length of said actuating rod of said actuator which is actuated according to a control signal from said control unit.

20. An apparatus for controlling exhaust gas in an internal combustion engine, comprising:

an exhaust pipe for outwardly releasing exhaust gas from the engine;

a bypass pipe variable in length which diverges from said exhaust pipe with a distance and has U-shaped and reverse U-shaped sections formed alternately;

an actuator having an actuating rod connected to said bypass pipe to vary the length of said bypass pipe; and a control unit for controlling said actuator, wherein said bypass pipe includes first fixed members diverging from said exhaust pipe with a distance, first and second reverse U-shaped movable members movably arranged to said first fixed members, a U-shaped second fixed member fixed between said first and second reverse U-shaped movable members, said first and second reverse U-shaped movable members being movable with respect to said second fixed member, wherein said first and second reverse U-shaped movable members are varied in length according to a variation in length of said actuating rod of said actuator which is actuated according to a control signal from said control unit.

* * * * *